United States Patent [19]

Friel

[11] Patent Number: 4,627,194

[45] Date of Patent: Dec. 9, 1986

[54] METHOD AND APPARATUS FOR KNIFE AND BLADE SHARPENING

[76] Inventor: Daniel D. Friel, Box 4319, Greenville, Del. 19807

[21] Appl. No.: 588,794

[22] Filed: Mar. 12, 1984

[51] Int. Cl.[4] ..... B24B 9/00

[52] U.S. Cl. ..... 51/58; 51/170 MT; 51/241 G

[58] Field of Search ..... 51/57, 58, 60, 74 BS–92 BS, 51/108 BS, 98 BS, 109 BS, 116, 119, 128, 102, 6, 205 WG, 208, 210, 214, 241 G, 285, 170 MT; 269/8

[56] References Cited

U.S. PATENT DOCUMENTS

| | | | |
|---|---|---|---|
| 1,373,140 | 3/1921 | Long | 51/6 |
| 2,367,668 | 1/1945 | Champayne | 51/170 |
| 2,412,141 | 12/1946 | Ford | 51/119 |
| 2,645,063 | 7/1953 | Smith | 51/98 |
| 2,673,426 | 3/1954 | Speare | 51/210 |
| 2,722,790 | 11/1955 | Smith | 51/170 |
| 2,751,721 | 6/1956 | Smith | 51/128 |
| 2,775,075 | 12/1956 | McMaster et al. | 51/128 |
| 3,041,790 | 7/1962 | Ettman | 51/102 |
| 3,071,899 | 1/1963 | Hicks et al. | 51/128 |
| 3,277,610 | 10/1966 | Mazur | 51/119 |
| 3,576,089 | 4/1971 | Magnuson | 51/59 |
| 3,609,922 | 10/1971 | Schnizer et al. | 51/170 T |
| 3,844,067 | 10/1974 | Guerra et al. | 51/109 BS X |
| 3,874,120 | 4/1975 | Dalton et al. | 51/59 R |
| 3,924,360 | 12/1975 | Haile et al. | 51/222 |
| 4,052,174 | 3/1976 | Grat | 51/81 BS |
| 4,183,180 | 1/1980 | Magnuson | 51/58 |
| 4,287,687 | 9/1981 | Wilson | 51/119 X |

OTHER PUBLICATIONS

Thomas Dalton Microtome Knife Sharpener Model 205, bulletin 164, Philadelphia, Pa.

*Primary Examiner*—Frederick R. Schmidt
*Assistant Examiner*—Debra S. Meislin
*Attorney, Agent, or Firm*—Connolly and Hutz

[57] ABSTRACT

A method and apparatus for sharpening knives, and the like where fixed abrasive elements on an orbiting surface in contact with the knife cutting edge facet move in a mechanically generated uniform cyclic orbit of circumference less than about one (1) inch and through that motion provides the work and energy to sharpen the knife or blade edge. The apparatus provides a circumferential velocity of the abrasive element of less than 800 feet per minute and restrains motion of the abrasive surface to less than ±0.005 inch in a direction perpendicular to the intended plane of the knife or knife edge facet. The apparatus contains novel magnetic device to steady, guide and control position and angle of the face of the blade relative to the orbiting abrasive elements, to realign any burr or sharpening debris on the knife edge, to control in part the abrading forces, and to remove sharpening debris from the abrasive surface and sharpening zone. A drive used to create the orbital motion of the abrasive surface utilizes a pair of synchronously driven eccentric cranks that engage an orbiting drive plate that supports the abrasive surface or surfaces, where the eccentric cranks are mounted on or are an integral part of the shafts of two gear pulleys driven syncronously by a motor-driven timing belt, and where the supporting drive plate is constrained to orbit in a prescribed principal plane by fixed bearing support points.

17 Claims, 19 Drawing Figures

METHOD AND APPARATUS FOR KNIFE AND BLADE SHARPENING

CROSS REFERENCE TO RELATED APPLICATION

This application is related to an application Ser. No. 588,795, filed Mar. 12, 1984, entitled "Improved Method and Apparatus for Knife and Blade Sharpening".

BACKGROUND OF THE INVENTION

This invention relates to an improved method and apparatus for the sharpening of knives and blades.

There are myriads of knives and the like whose cutting edge must be sharpened either initially or following use. The term "knife" includes professional knives, household knives, blades, swords, surgical tools, razor blades, scissors, chisels, plane blades, and other surfaces having a cutting edge. Commonly household knives and the like are sharpened during manufacture by bringing the cutting edge facets in contact with an abrasive wheel, sometimes in the presence of a coolant such as water or water/oil emulsion particularly where the wheel rotates at high speed. The knife is usually held parallel to and against the perimeter surface (thickness) of the abrasive wheel (FIG. 1) so that moving abrasive elements on the perimeter surface move essentially perpendicular to the long axis of the knife edge. The grit or agglomerate particle size employed in such wheels is commonly such that grooves on the order of ¼ to 2 mils wide and deep are cut into the knife surface more or less perpendicular to the edge (FIG. 14). These grooves create in effect a serrated edge on the knife that severs largely through a tearing action.

The average commercial knife when viewed with optical magnification can be seen to have an edge somewhat similar to a serrated bread knife. The microteeth on such knives created by the serration become bent during use and commonly are straightened by means of a steel "sharpening" rod that realigns the microteeth. After several "resharpenings" with a steel rod, the teeth become weak and break off, and the knife needs to be reground to be an effective cutting tool. The resharpening process usually consists of again presenting the knife edge to the edge of an abrasive wheel surface.

Household knife sharpeners sold by a variety of manufacturers incorporate high-speed cylindrical stones (FIG. 3) rotating at speeds of about 3000 RPM with surface velocities up to 2000 feet per minute as described in U.S. Pat. No. 2,775,075. The knife cutting edge facet is brought into contact with the beveled edge of a rotating stone so that the abrasive surface is moving in a relatively fixed or limited number of directions relative to the knife edge. These contain coarse grits that grind the knife cutting edge facets, leaving a poorly defined knife edge. At these high abrasive velocities, if the knife is moved nonuniformly or abruptly along the rotating stone, it is possible to create an undesirable scallop on the edge or to overheat the knife edge locally, degrading the temper or gouging the surface of the knife cutting edge facet. Sharpeners of this type are sometimes incorporated as part of household can openers.

An assortment of abrasive rods, sticks, and flat stones are available that are used in a variety of manual sharpening methods. Manual methods lack adequate means to consistently control the sharpening angle and the resulting knife edge is neither well defined nor uniformly sharp.

One manual method of resharpening knives consists of manually stroking the knife cutting edge facet across a static abrasive surface such as Arkansas stone (FIG. 2), carborundum or commercial alumina. Such sharpening stones usually must be coated with oil, or water, during the sharpening process in order to float off sharpening debris removed during sharpening from the knife cutting edge facets and to minimize loading the pores of the stone with abrasive and metallic particles that reduce edge quality and the sharpening rate. Manual methods are seriously disadvantaged by the lack of reproducible motion during individual strokes, by variations in abrading rates during strokes, and by poor angular control. With manual methods it is virtually impossible either to maintain a constant angle of the cutting edge facet relative to the abrasive surface during the manual stroking process, to hold uniform pressure throughout a sharpening stroke, or to avoid damage to the edge from accumulated sharpening debris on the abrasive surface with the consequence that only those highly skilled can hope to obtain a satisfactorily sharp edge.

A major disadvantage of prior art methods is that the edge tends to be left with a sizeable burr, i.e., a curled-over edge of metal on the last unsharpened facet of the blade edge. The presence of a sizeable burr is undesirable as it leaves a poorly deformed, dull, and weak edge on the knife. Both prior art mechanical and manual means leave the knife cutting edge facet scratched along the edge and, in effect, establish a serrated edge that tears while it cuts.

Another type of sharpener, for microtome knives, is described in U.S. Pat. Nos. 3,041,790 and 3,844,067. It utilizes a highly complex arrangement to slowly stroke the knife cutting edge facet in a straight line as it is held against a glass plate coated with loose abrasive material in a suspension. The glass plate is translated laterally and slowly in a circular path for the purpose of keeping the loose abrasive particles more or less evenly dispersed over the plate surface and to reduce their tendency to pile up in small areas on the plates. In these sharpeners the knife is held with pressure against the plate and ground first on one side and then the other by moving the plate or knife slowly and repetitively in essentially long straight lines. The energy of sharpening is provided predominantly by the straight line motion of the knife relative to the loose abrasive on the plate. The result is a micro serrated edge on the knife.

Manufacturers of microtome sharpeners, such as the Thomas Dalton Microtome Knife Sharpener, as described in U.S. Pat. No. 3,874,120 and Bulletin No. 164 of Arthur H. Thomas Company, teach the merits of abrading the knife cutting edge facet to create sets of microscopic scratches aligned at two different angles to the edge and meeting at the edge so as to generate a uniform cross-hatched "X" pattern on the knife facets. This action, like others, tends to create microteeth on the cutting edge with the attendant disadvantages discussed above.

Other known knife sharpening methods include moving water-cooled sandstone wheels or endless abrasive-coated belts. These move the abrasive in a direction essentially perpendicular to the knife edge, thus creating grooves on the facet and microteeth on the edge. Lack of surface planarity of abrasive surface and poor control of the knife position and the angle of the cutting edge facet in these sharpeners commonly leave imperfections along the knife edge. These sharpeners are expensive and often too complex for common household use. Commercially it is commonly necessary to use a fabric buffing wheel to remove burrs remaining after use of such sharpeners.

U.S. Pat. No. 2,645,063 and related U.S. Pat. No. 2,751,721 describes sharpeners that incorporate a magnet. The magnetic field is not incorporated as a part of the knife guide nor to support the weight of the knife. Also its geometry and field orientation renders it ineffective for removal of sharpening debris from the abrasive surface.

Prior art commonly teaches the use of higher surface speed of the abrasive in motor driven sharpening equipment. As described in U.S. Pat. No. 2,775,075 "it has been determined experimentally that the ordinary steel knife cannot be sharpened effectively if the cutting velocity is less than about 500 feet per minute."

Prior art teaches in large that the preferred means to create fine cutting edges is to maintain a motion of the abrasive in a direction largely perpendicular or at some relatively fixed angle relative to the length of knife edge. The result of prior art methods often is a serrated knife edge complete with gouges, edge burrs, and often burned metal. None of these described known means of sharpening have proven wholly satisfactory for sharpening of knives.

SUMMARY OF THE INVENTION

Many of the disadvantages associated with prior art knife sharpeners are significantly reduced by the sharpening methods and apparatus of this invention.

According to the method of this invention, a knife's cutting edge is sharpened by subjecting the cutting edge facets to a uniform repetitive cyclic orbital motion of abrasive elements, the orbit of each element is separate and lies substantially in or parallel to a common plane, i.e., the principal plane of the elements, such that material is removed from the facet by uniform omnidirectional abrasive action in the common plane. The amplitudes of the orbital path of the abrasive elements is essentially equal for each element. During sharpening the cutting edge facet is positioned mechanically or preferably magnetically relative to the principal plane of the abrasive elements and ferromagnetic debris being removed from the knife cutting edge facet is magnetized and thereby removed from the abrasive elements and sharpening zone.

The sharpening action described here is unique in part because of the fact that the energy consumed in sharpening is applied to the knife cutting edge facet predominantly by the uniform cyclic orbital motion of the abrasive particle against the knife edge facet. This insures that the cutting edge facet is uniformly abraded. This is in sharp contrast to other knife sharpeners where the energy is conveyed through predominantly some form of rectilinear motion of the abrasive particles across the knife cutting edge facet.

An apparatus for performing this method includes an orbiting member having an abrasive surface where each abrasive element on the surface moves in a uniform cyclic fixed separate orbit, ideally circular, in or parallel to a principal plane, i.e., the plane of the abrasive surface, and where the work and energy expended in sharpening is provided predominantly through the orbital motion of the abrasive surface particles. The amplitude of each orbital path is about equal. The principal plane is defined here as that plane of the abrasive surface which contains the predominant number of abrasive surface elements. Each abrasive element moves in a path in or parallel to the principal plane about an individual and separate point for each element. This apparatus produces for unskilled users the means to create knife edges of superior quality.

The orbiting member of this invention preferably is planar and may have an abrasive surface on both sides but for special uses can be a modified shape such as a single or multiple convex surface to remove metal faster. It can be for example a solid abrasive material or a supporting structure covered with physically bound abrasive particles. This sharpening process is optimized when the velocity of the abrasive particles is less than 800 feet per minute, when the plane of the moving abrasive is stabilized to reduce transverse motion to less than ±0.005 inch and when the length of each orbital path is less than one (1) inch. The plane of the orbiting abrasive is stabilized by a drive plate that is restrained to orbit in slidingly contact with three or more bearing support points.

Loose abrasive particles are unsatisfactory, because of their tendency to move around nonuniformly and to pile up or ball-up thereby destroying the planarity or uniformity of the surface contour. Such nonuniformity can damage the knife edge. It was found that the quality of edge formed is substantially better and the sharpening rate or rate of metal removed is much greater with bound particles that maintain fixed orbital motion. Further, with loose particles the sharpening debris intermingles with the abrasive adding to the balling-up effect.

The knife being sharpened can be clamped into correct position but more conveniently is held by its handle while the knife is guided and supported at least in part by a suitable mechanism which in a preferred embodiment is a magnetic guide means that attracts the face of the knife to its surface and steadies the knife while allowing successive portions of the cutting edge facet of the knife to be guided into parallel contact with the orbiting abrasive surface. The magnetic field serves also importantly to remove sharpening debris from the abrasive surface and to minimize its accumulation in the region between the orbiting abrasive surface and the knife guide.

A stop for the cutting edge facet can be used in conjunction with this sharpener. When used it is positioned to contact some part of the cutting edge facet just above the intersection of the planes of the abrasive elements with the plane of the knife guide. The guide orients the knife cutting edge facet so that it can be brought into intimate line contact with the abrasive plane and holds the face of the knife at an appropriate angle with the abrasive plane to create the desired angle of the cutting edge facet relative to the face of the knife. The stop serves to stabilize the knife against the orbiting surface, to reduce opportunity for the knife edge to slip into any finite space between the guide and orbiting surface, to serve as a means of removing loose sharpening debris from the knife edge, and to reorient any microburrs or debris attached to the knife edge into such position that they can be readily removed by the orbiting abrasive surface.

Magnetic guides located contiguous to the abrasive surface are disclosed that position the knife precisely, concentrate the magnetic flux near the knife cutting edge to remove sharpening debris and that act to minimize opportunity for the knife to wedge between the guide and moving abrasive surface.

The method and apparatus of this invention provide for the unskilled a novel and low-cost means of generating knife edges of superior sharpness and cutting quality essentially free of microserration as created by most present-day sharpening devices. The unique and precise magnetic guides described control the angle of the knife and reduce movement of the knife during sharpening relative to the orbiting abrasive surface and remove sharpening debris. These guides can be used also to control the knife position relative to abrasive surfaces moving in any one of a variety of other modes.

BRIEF DESCRIPTION OF THE DRAWINGS

The invention itself, will be more fully understood from the following description when read, together with the accompanying drawings, in which.

DETAILED DESCRIPTION

The Method

Figure 1:
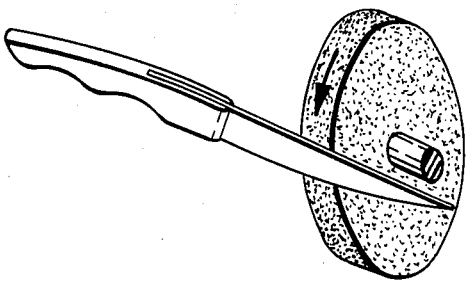
Fig. 1. (Prior Art)
FIG. 1 is a schematic drawing of a typical prior art method of sharpening knives using the edge of a grinding stone.
Figure 3:
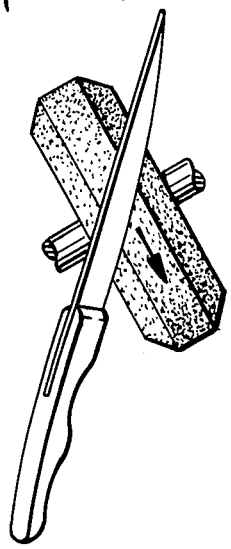
Fig. 3. (Prior Art)
FIG. 3 is a schematic drawing of a prior art household method of sharpening knives using a beveled rotating stone.
Figure 2:
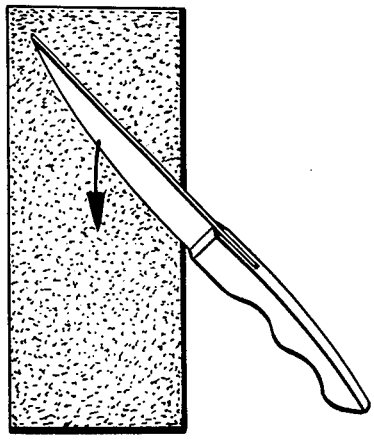
Fig. 2. (Prior Art)
FIG. 2 is a schematic drawing of a prior art method of sharpening knives using a flat stone.

In the present invention sharpening of knives and the like is accomplished predominantly by a mechanically generated uniform cyclic orbital motion of an abrasive relative to the knife edge that provides a uniform omnidirectional abrasive action. The term "knife edge" as used in this description for the sake of simplicity, refers to the cutting edge of any type of tool which can be sharpened according to this invention. These tools include knives, scissors, chisels and the like. The terms knife, blade and tool can be considered equivalent in the context of this patent application.

According to this invention, the energy for sharpening through metal removal is provided by means of the uniform cyclic orbital abrasive motion. Moving the abrasive particles in a common plane across the knife cutting edge facets repeatedly with equal omnidirectional abrasive action through means of the uniform orbital motion of the abrasive produces surprisingly a knife edge of superior quality virtually free of burrs and microserrations. The quality of edge produced is substantially and consistently better than that possible through prior art manual motions or mechanically created rotary or rectilinear motions.

In the method of this invention, each abrasive particle moves in a separate orbit in or parallel to the principal plane of the abrasive surface. The orbital path taken in a revolution by each particle is $\pi d$ where d is the diameter of its circular orbit. Ideally the path is circular in order to give uniform omnidirectional abrasive action, but where the path is mildly elliptical because of characteristics of the mechanical drive, the orbital path is the distance measured around the elliptical path. Whether circular or mildly elliptical, in any given drive arrangement, the orbital path distance of each particle is essentially equal and the motion is highly uniform and omnidirectional.

The velocity imparted to each abrasive particle must be large enough to provide a cutting action that can remove metal rapidly yet not so great as to overheat the unusually fine thin knife edge produced by this method, where the edge is on the order of one ten thousandth inch or less in thickness, and thereby draw its temper. The circumferential speed of the abrasive element should preferably be held below 800 feet per minute to avoid overheating the edge, and as the edge becomes very fine and thin, lower linear speeds are desirable.

A superior edge results if the orbital path is less than one inch in circumference so that any burr formed at points on the knife edge during that portion of one orbital cycle where abrasive motion is perpendicular to the edge is removed promptly and reliably by an abrasive element during that next portion of cycle where the elements move parallel to the edge. Prolonged motion by the abrasive across or normal to the edge can create a burr that becomes extensive in size and difficult to remove by the next transverse motion of the orbiting abrasive. In the manner of this invention burrs never become large or excessive in number and the knife edge has a uniform appearance with a strong cutting edge nominally comparable with that of a commercial scalpel.

The knife being sharpened is moved along a guide by hand but it is steadied and maintained at the desired sharpening angle by that guide which in a preferred embodiment uses a magnetic field to ensure good contact of the knife against the guide and to provide other advantages discussed here. The knife can be held relatively stationary or moved slowly through or along the guide either manually or by a mechanical means in a direction along the length of the knife while one knife cutting edge facet is held in contact with the orbiting abrasive. After that edge facet is suitably sharpened, the knife is repositioned so that the second cutting edge facet of the knife is brought into contact with an orbiting abrasive member and the knife is moved slowly across that member until the second facet is suitably sharpened. This process can be repeated until the cutting edge facets form a fine edge along the useful length of the knife. Clearly more than one orbiting abrasive member or surface can be employed in a number of mechanical arrangements, and a variety of materials and grit sizes can be provided.

In this sharpening process it is important that the plane of the face of the knife and the plane of the surface of the orbiting abrasive member be maintained at a constant, non-varying, angle relative to each other during sharpening so that the knife cutting edge facet being abraded is forced to conform precisely and uniformly and in a controlled stable manner to the orbiting surface. For this and other reasons, it is desirable that the sharpener ensure that during the sharpening process the principal plane of the abrasive member not move transversely, that is in a direction perpendicular to the principal plane, more than ±0.005 inch or more than 0.1 degree angularly as related to the knife and its cutting edge facet as positioned by the guide.

One means by which this angular precision can be obtained in accordance with this invention is to secure the orbiting abrasive member or an extension thereof by suitable means to a driven plate that is restrained to orbit over three or more rigid mechanical "point" contacts secured to an adjacent support member. The guide used to control knife position and angle of the cutting edge facet also preferably is secured to the same adjacent support member so that transverse and random motions of the apparatus affect alike the orbiting abrasive and the knife guide.

Apparatus for Sharpening

Figure 4:
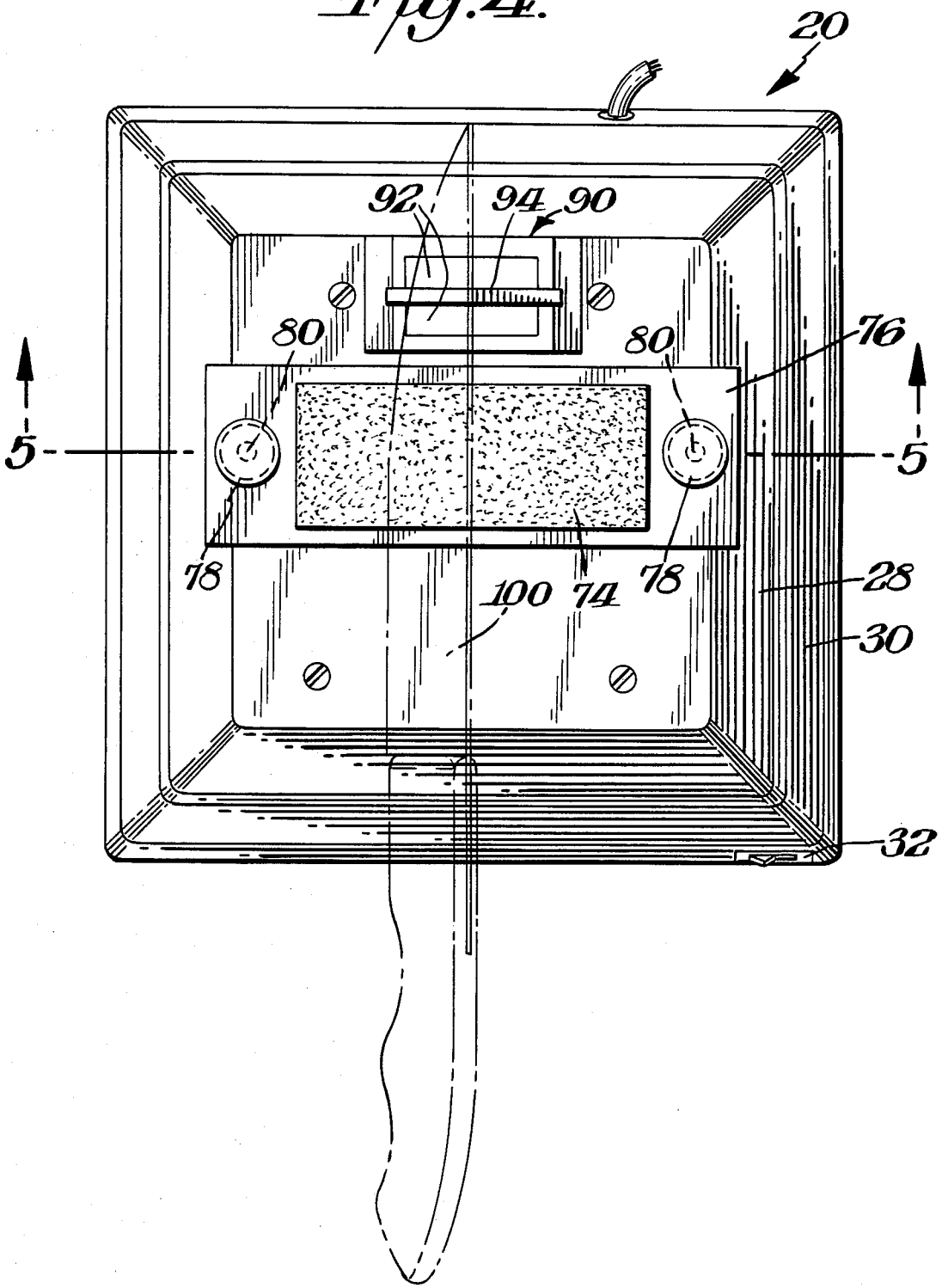
FIG. 4 is a top plane view of a knife sharpening device constructed in accordance with this invention.
Figure 6:
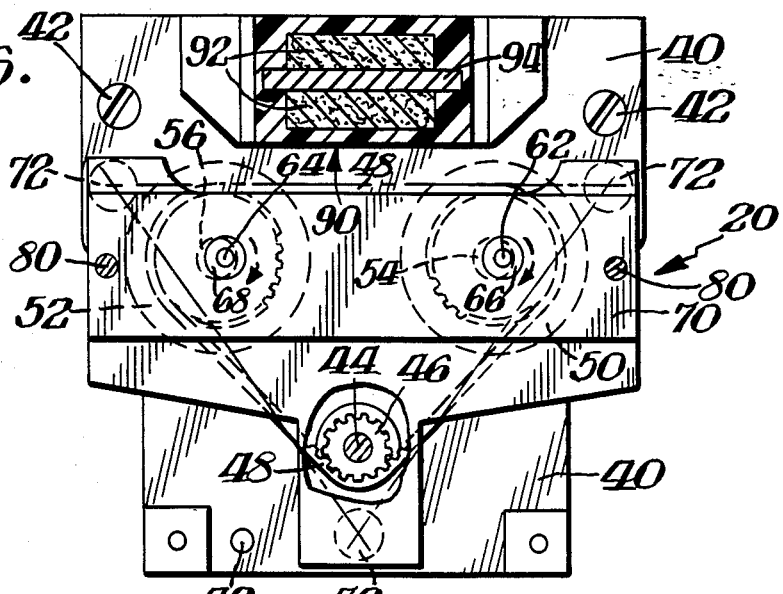
FIG. 6 is a fragmental top plan view taken along line 6—6 of FIG. 5 showing the orbital drive mechanism of the knife sharpening device of FIG. 4.
Figure 5:
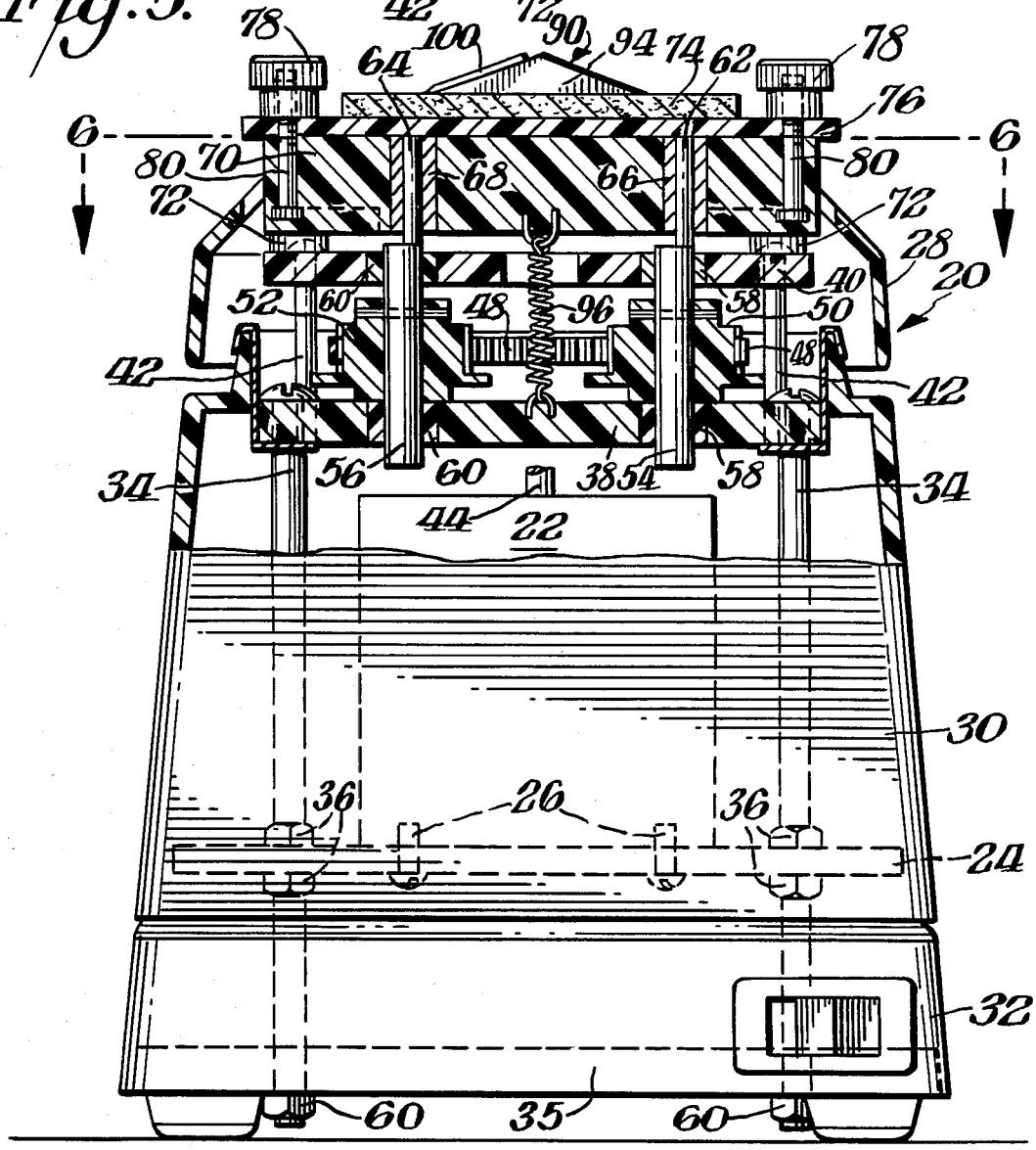
FIG. 5 is a cross-sectional view, taken along line 5—5 of FIG. 4, showing the drive mechanism for the knife sharpening device of FIG. 4.

One mechanical arrangement for a sharpener 20 with an orbiting motion for performing the method of this invention is illustrated in FIGS. 4 through 6. A motor 22 FIG. 5 is attached to motor mounting plate 24 by screws 26 within a three piece enclosure consisting of upper section 28 a middle section 30, and a lower section 32. Four vertical threaded bolts 34 fastened securely to a base plate 35 support the horizontal motor mounting plate 24 by means of nuts 36 and support horizontally mounted lower plate 38 into which the upper end of bolts 34 are threaded. Lower plate 38 supports horizontally mounted upper plate 40 by means of three spacer bolts 42. Attached to motor shaft 44 is a gear pulley 46 of FIG. 6 that drives in a horizontal plane timing belt 48 which in turn drives synchronously gear pulleys 50 and 52 mounted on vertical drive shafts 54 and 56, respectively. The ends of drive shafts 54 and 56 rotate within drive shaft bearings 58 and 60, respectively, pressed into lower plate 38 and upper plate 40. The upper ends of drive shafts 54 and 56 are machined to form drive cranks 62 and 64 respectively that engage crank bearings 66 and 68 respectively. Crank bearings 66 and 68 are embedded in a horizontally orbiting drive plate 70 that is caused to orbit horizontally by the drive cranks 62 and 64 driven synchronously by gear pulleys 50 and 52 off the common timing belt 48. Orbiting drive plate 70 rests on three support bearings 72 that act as support points and are in turn attached to fixed upper plate 40.

An abrasive material 74 forming a surface is secured by a suitable adhesive to a horizontal abrasive support plate 76 that is attached to the orbiting drive plate 70 by means of two thumb nuts 78 that thread manually onto stud screws 80 embedded into orbiting drive plate 70.

A magnetic guide assembly 90 is rigidly fastened to upper support plate 40 by adhesive or other means. The assembly 90 incorporates two magnets 92 so magnetized that their like magnetic poles face knife guide plate 94 made of a ferromagnetic material such as mild steel. This guide plate 94 terminates in a triangular top to serve as a guide or rest for the face of a knife 100. The face of the steel knife 100 is attracted magnetically to rest on one of the sloping edges of the triangular top of guide plate 94 as shown in FIGS. 4 and 5. The slope of the triangular top of guide plate 94 is selected to insure that the desired sharpening angle is created between the face of the knife 100 and the surface of the abrasive material 74 which is caused to orbit by virtue of its attachment to the abrasive support plate 76 which in turn is attached to orbiting drive plate 70 by thumb nuts 78. The latter provides a convenient means by which to interchange the abrasive surface.

Eccentric motion of the cranks creates an orbiting motion, of the orbiting drive plate 70, which is constrained by a spring 96 to remain in a predetermined plane. This plane is defined by the three support bearings 72 made of a material such as an ultra high molecular weight polyolefin or glass-filled fluorocarbon and secured to the upper plate 40. Prior mechanical means of supporting orbiting members such as in sanders include parallelogram type structures, three or more flexible columns, elastomeric supports, etc. The plane of orbiting sander pads moves both angularly and in a direction perpendicular to the pad surface to such an extent that such means can not be used to place a precision edge on a knife.

Crank bearings 66 and 68 are made of a suitable material such as glass-filled Teflon® fluorocarbon resins. This material provides an aligning and wear surface for the eccentric drive cranks 62 and 64 on the ends of drive shafts 54 and 56. Wear of the orbiting drive plate 70 could occur if the cranks contacted directly the drive plate 70 itself. Drive shaft bearings 58 and 60, also of a composition such as glass-filled Teflon®, serve as a bearing for steel drive shafts 54 and 56 where they pass through stationary lower plate 38 and upper plate 40. Alternatively the upper support plate 40, lower support plate 38 and orbiting plate 70 can be made of a material such as a polyester or a die cast zinc-aluminum alloy that can serve both as the structural material for those plates as well as the bearing material. By that means those bearings just described can be eliminated.

In some configurations it was found advantageous to have an elastomeric sleeve or equivalent (not shown in drawings) inserted between the crank bearings 66 and 68 and the orbiting drive plate 70 as a means of reducing transverse vibrations caused by imperfections in the synchronization of the eccentric drive cranks 62 and 64 or other mechanical imperfections that otherwise would be transmitted to the abrasive material 74. Such vibrations if excessive can limit the quality of the resulting knife edge.

Vibrations of the orbiting drive plate 70 and the abrasive material 74 attached thereto can be reduced by employing a drive system that in itself generates little vibration. The arrangement shown in FIGS. 5 and 6 using the segmented (with teeth) timing belt 48 with gear pulleys 46, 50, and 52 has proven superior to conventional rigid gear drives that can otherwise accomplish the same synchronous motions but were found to generate greater vibration and noise. The use of a timing belt 48 tends to isolate and reduce the level of vibrations that otherwise are generated or transmitted from the motor 22 through intermediate bearings, etc. to the abrasive material 74. An acceptable equivalent would be a gear train made of elastomeric materials where the durometer is carefully chosen.

Transverse vibrations (vertically in FIG. 5) of the orbiting drive plate 70 and attached abrasive material 74 can be held to a minimum by locating the drive cranks 62 and 64 and spring 96 within the triangular space defined by the three support bearings 72 as shown in FIG. 6. The spring 96 mounted about centrally between support bearings 72 and anchored under tension between lower plate 38 and orbiting drive plate 70 must be sufficiently strong to minimize vertical motion of the horizontal orbiting drive plate 70 but not so strong as to create excessive friction between the orbiting drive plate 70 and support bearings 72. A magnet and metal plate arrangement could be used as an alternative to the spring with one of the two attached to the orbiting drive plate and the other attached to upper support plate 40.

The orbital motion normally will be essentially circular if drive cranks 62 and 64 are in perfect syncronization. But if the drive cranks 62 and 64 are out of syncronization or if there is serious imbalance of the orbiting drive plate 70 when there is an elastomeric material or large clearances between the cranks and rigid orbiting drive plate 70, the orbital motion will be more or less elliptical.

Abrasive material 74 can be any of a variety of different fixed abrasive materials and different coarseness or "grit" size equivalent. Plates have been used successfully containing diamond grit on steel, Arkansas stone, carborundum blocks, alumina blocks, and abrasive alumina coated papers of various grit sizes, to name a few. The triangularly topped knife guide plate 94 is constructed to be a snug finger-tight fit into a slot between the two magnets 92 and can be manually replaced with another knife guide plate of different angular configuration in order to change the sharpening angle. The second cutting edge facet of the knife can be sharpened simply by resting the face of the knife on the other side of the knife guide plate 94. The magnetic attraction provided by the knife guide plate 94 is large enough to control and align one end of the knife 100, but not so large as to prevent the operator from moving the knife 100 back and forth to sharpen the entire edge of the knife 100. The magnetic force serves importantly also to assist in restraining any random motion of the knife that might otherwise be created because of forces generated on the cutting edge facet of the knife during sharpening against the orbiting abrasive material 74.

Figure 7:
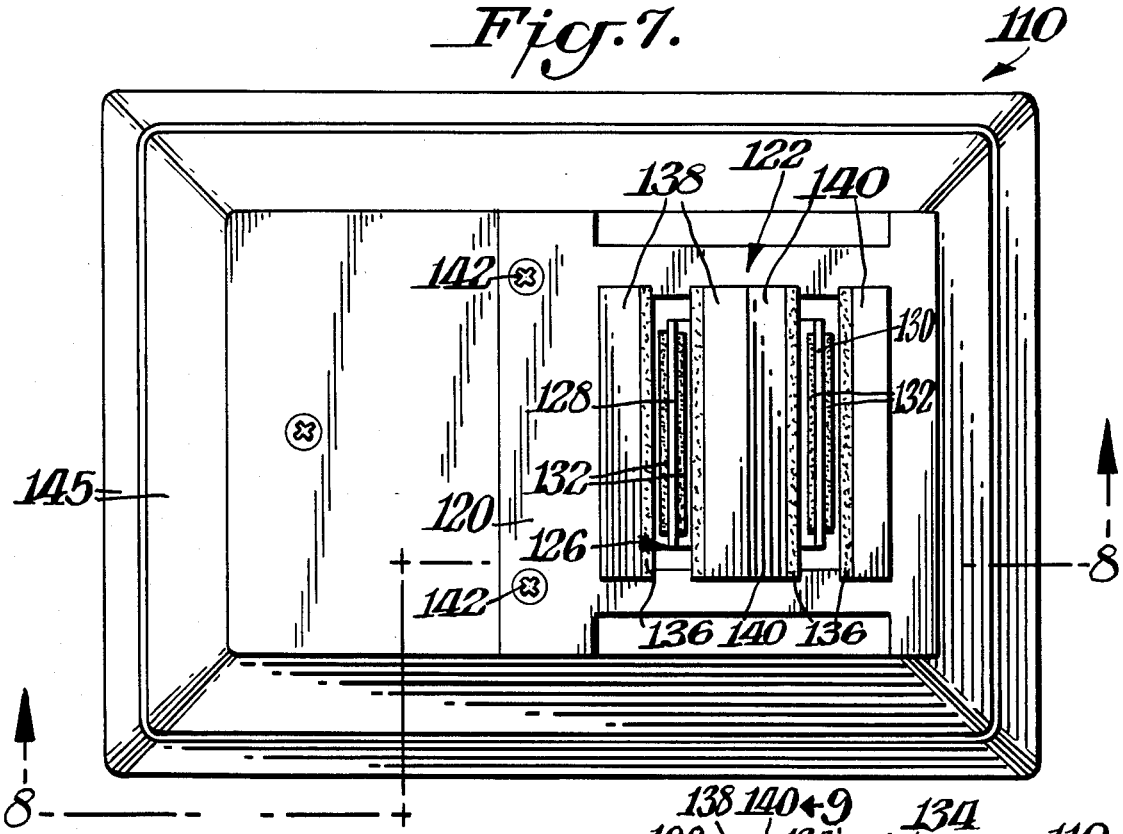
FIG. 7 is a top plan view of an alternative embodiment of a knife sharpening device constructed in accordance with this invention.
Figure 8:
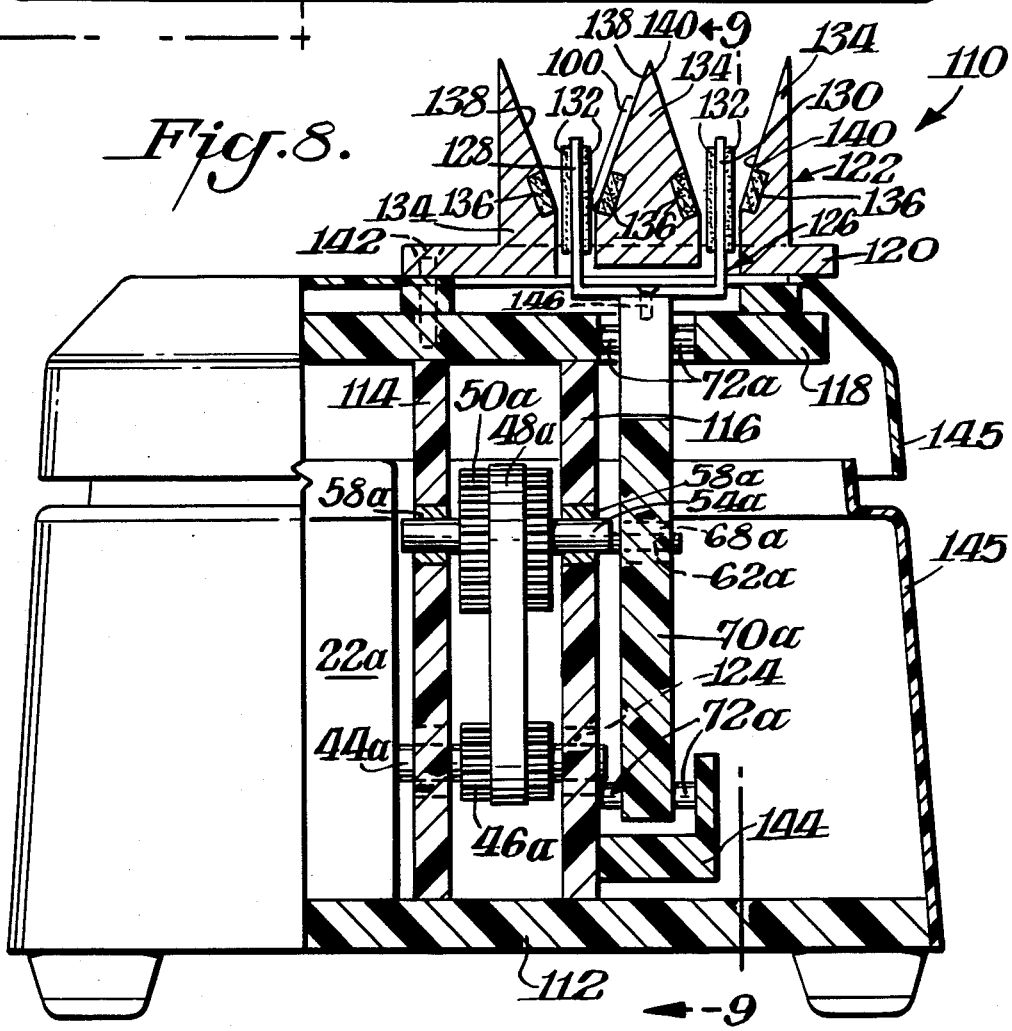
FIG. 8 is a cross-sectional view in elevation taken along line 8—8 of FIG. 7 showing the orbital drive system employed in the embodiment of FIG. 7.
Figure 9:
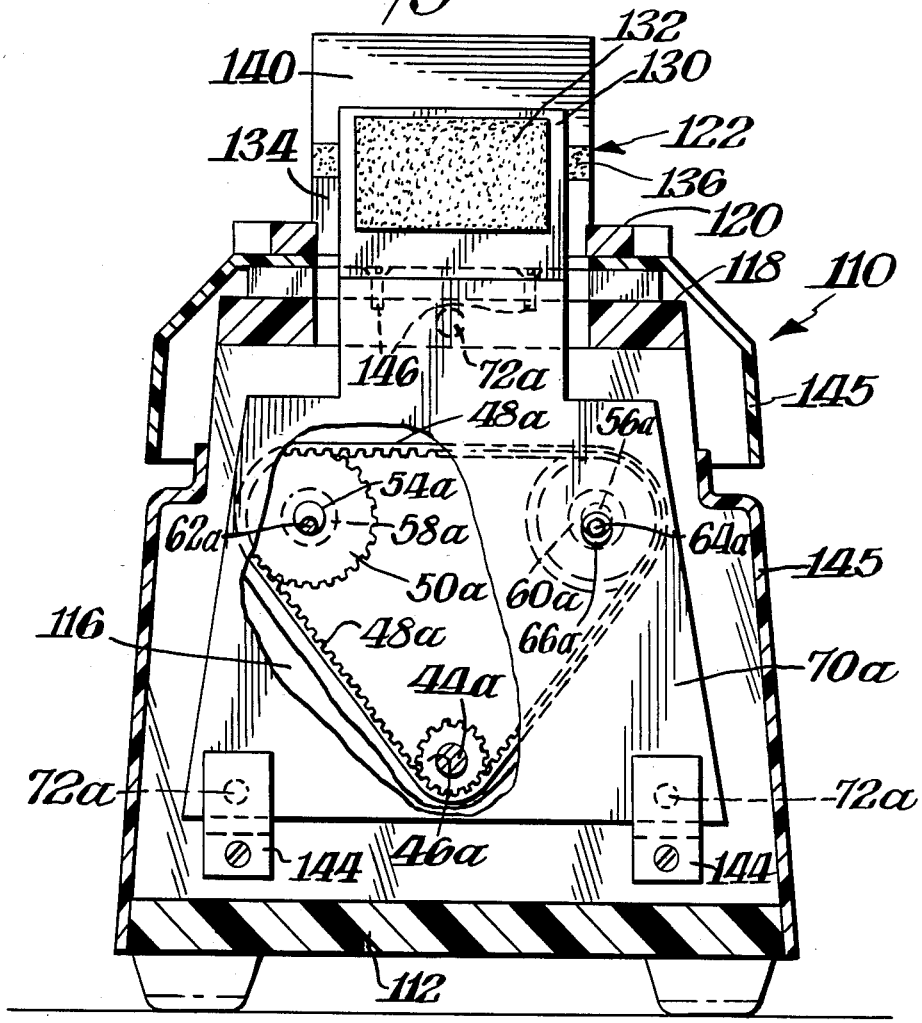
FIG. 9 is a cross-sectional elevational taken along 9—9 of FIG. 8 with a portion broken away showing the orbital drive system of FIG. 8.

The fact that the basic teachings of this invention can be employed in many different mechanical configurations is demonstrated by illustrating two knife sharpeners of substantially different configurations, the first sharpener 20 as shown in FIGS. 4 through 6 and the second, sharpener 110 in FIGS. 7 through 9. In the second configuration, sharpener 110, the orbiting drive plate **70*a* is driven by a mechanism similar to that shown in FIGS. 5 and 6**.

The second embodiment of this invention, sharpener 110, is shown in FIGS. 7, 8 and 9 in which the orbiting abrasive surfaces move in a vertical plane. In this embodiment, a motor **22*a* of FIG. 8 is mounted on base plate 112 and drives a gear pulley 46*a* mounted on motor shaft 44*a*. Timing belt 48*a* driven by gear pulley 46*a* drives gear pulleys 50*a* and 52*a* mounted on horizontal drive shafts 54*a* and 56*a* whose ends are machined to form drive cranks 62*a* and 64*a*. The drive cranks 62*a* and 64*a* driven synchronously by this belt-gear pulley arrangement engage into crank bearings 66*a* and 68*a* mounted in an orbiting drive plate 70*a* so that orbiting drive plate 70*a* is driven in an orbital path. Vertical support plates 114 and 116, FIG. 8, mounted on the base plate 112 provide support and alignment for motor shafts 44*a* and drive shafts 54*a* and 56*a*, and support for upper plate 118 and guide support plate 120, that in turn supports a knife-guide assembly 122. Shaft bearings 58*a* and 60*a* mounted in vertical support plate 116 provide support for one end of drive shafts 54*a* and 56*a*. Similar bearings 58*a* and 60*a* are mounted in vertical plate 114 for the other end of drive shafts 54*a* and 56*a*. A motor shaft bearing 124 provides support for the end of motor shaft 44*a*. It is mounted in vertical support plate 116. Orbiting drive plate 70*a* supports a yoke 126 made of metal or plastic whose upper arms 128 and 130 serve as mounting supports for abrasive materials 132 that orbits within the stationary knife guide assembly 122**.

Figure 10:
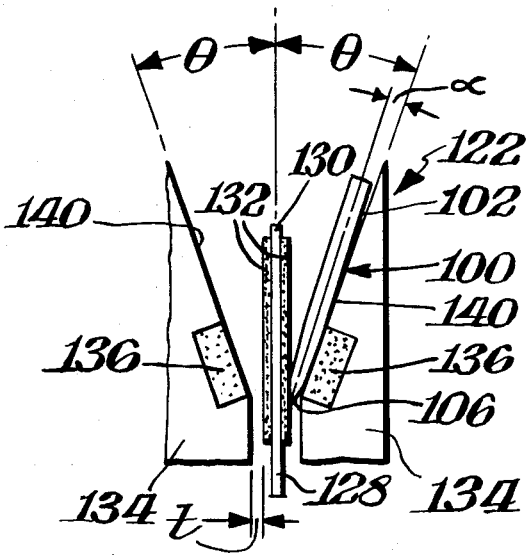
FIG. 10 is a diagramatic detail view in cross-sectional elevation of a knife guide employing a magnetic material to control sharpening angle in accordance with this invention.

The knife guide assembly 122 is constructed in part of a suitable plastic such as polycarbonate forming support members 134 that hold magnetic elements 136 shown in greater detail in FIG. 10. In use the face of the knife 100 of FIG. 8 rests on faces 138 or 140 of the guide assembly 122 with the knife attracted magnetically toward the guide face 138 or 140 by one of the magnetic elements 136. The knife-guide assembly 122 is either affixed to guide support plate 120 with a structural adhesive such as an epoxy or alternatively the plastic support member 134 of the knife guide assembly 122 and guide support plate 120 are molded as one integral structure. Screws 142 are used to hold guide support plate 120 with knife guide assembly 122 onto the upper plate 118. The entire guide support plate 120 with knife guide assembly 122 can be replaced if desired with another that establishes a different angle of guide faces 138 and 140 with the orbiting abrasive material 132.

Magnetic elements 136 whose faces are normally coplanar with the guide faces 138 and 140 attract the knife, guide the knife, position the knife at the desired angle relative to the orbiting abrasive, and minimize the movement of the knife that would be caused by motion of the orbiting surface. Knife guide assembly 122 can have discrete magnetic elements or be surfaced in whole or only in part with a material composed of magnetic material in a plastic base such as that supplied by the 3M Corporation or others containing material that is magnetized and will attract magnetically susceptible materials such as the steels and alloys commonly used in construction of knives. Magnetic elements consisting of a two pole magnet with the magnetic poles parallel to the face of the knife and with ferromagnetic plates that concentrate the magnetic flux have particular advantages as discussed later in this application.

Orbiting drive plate 70*a* is held in position by at least three pairs of support bearings 72*a*, with pair members positioned on either side of orbiting drive plate 70*a* in slidingly contact with orbiting drive plate 70*a* and held in place by upper plate 118 and by lower bracket 144 fastened to vertical support plate 116 by adhesive or suitable screws, not shown. This maintains at all times a three point supporting means for orbiting drive plate 70*a*. In an acceptable alternative arrangement, not shown, the support bearings 72*a* could be affixed to the orbiting drive plate 70*a* and rest in slidingly contact with upper plate 118 and lower bracket 144. A two sectional enclosure 145 surrounds the apparatus.

Means are provided through a contact adhesive or other arrangement for removal and replacement of individual abrasive material 132 and/or for replacement of all abrasive materials 132 simultaneously with their supporting yoke 126 by means of screws 146 or other devices. At any time during sharpening, there is a small clearance on the order of 0.001 inch between certain of the support bearings 72*a* and the orbiting drive plate 70*a* but in use there is also actual contact between the orbiting drive plate 70*a* and three of the support bearings 72*a* depending on the direction of force of the knife against the abrasive material 132. At any time the orbiting drive plate is forced to cycle in one of several closely spaced planes established by the support bearings and the spacing between these bearings in slidingly contact with the plate. In this manner very positive support is provided at all times that stabilizes the plane of the orbiting drive plate 70*a* and the attached abrasive material 132. With this unique contact support means, there is no need for restraining springs or the like that would otherwise introduce greater frictional force on the face of support bearings 72*a* and increase the power requirements for the drive means.

Where there is some twisting force on the orbiting drive plate 70*a*, FIG. 8, caused by the sharpening action, more than the six support bearings 72*a* may be desirable. However when sharpening normally not more than three are being used at any instant in time. The crank bearings (66*a* and 68*a*), motor shaft bearing 124 and shaft bearings 58*a* and 60*a*, commonly made of glass filled Teflon® fluorocarbon resins, support the end of motor shaft 44*a*, eccentric cranks 62*a* and 64*a*, and the drive shafts 54*a* and 56*a*. These bearings can be eliminated if vertical support plates 114 and 116 and the orbiting drive plate 70*a* are made of a material such as a high temperature glass-filled polyester or other material that can serve both as a rugged structural material and as a bearing material. Any knife guide assembly 122 used with this sharpener should be supported through the guide support plate 120 onto upper plate 118, FIG. 8 and FIG. 9, or other rigidly attached member such as vertical support plate 116 that also provides direct or indirect support for the support bearings 72*a* that establish the position of the orbiting drive plate 70*a*. In this manner any major vibrations of the mechanical supporting structure incorporating members 116, 114, and 118 affect alike the knife guide assembly 122 and the orbiting components including 70*a*, 126, 128, 130 and abrasives 132. By this means the relative motion between the knife guide assembly 122 and the orbiting abrasive material 132 is minimized as caused by vibrations and movements of those major structural parts held together by structural adhesive or screws.

Screws 142 provide the means to interchange readily the knife guide assembly 122 so that the sharpening angle $\theta$, commonly about 20°, can be changed. Heavy knives used for chopping often are sharpened with a larger sharpening angle $\theta$, while light knives such as paring knives are sharpened commonly with a smaller angle.

The abrasive material 132 can be arranged for example so that the abrasive on both sides of upper arm 130 are a coarse material while both sides of upper arm 128 are a finer abrasive material. In this case, for example, both cutting edge facets of the knife are sharpened first on the coarse abrasive materials 132 on upper arm 130 and then both facets can be fine ground on fine abrasive materials 132 on upper arm 128. The sharpening angle for the finer abrasive can if desired be less than the angle used with the coarse abrasive.

It is also possible with two orbiting upper arms 130 and 128 for example as shown in FIGS. 8 and 9 to use four abrasive elements, each of different grit size, one in each of the four positions for abrasive materials 132. In that case, to sharpen, fine sharpen, or polish both cutting edge facets of the knife edge on individual abrasives, the knife is inserted first from the front and subsequently from the back side of the sharpener shown. FIG. 10 shows enlarged with a knife the right hand portion of the knife guide shown in FIG. 8. In FIG. 10, the support member 134 and magnetic material 136 are positioned away from the surface of moving abrasive material 132 at the point of smallest gap by a distance t. For common household knives a distance t in the range of 0.005 to 0.060 inch is preferred. The spacing, t, can be optimized to reduce the chances of jamming the drive mechanism if the moving abrasive or the operator cause the edge of knife 100 to work into this gap. Other guide means described later in this application employ modified designs to reduce further the opportunity to jam the drive mechanism.

Figure 11:
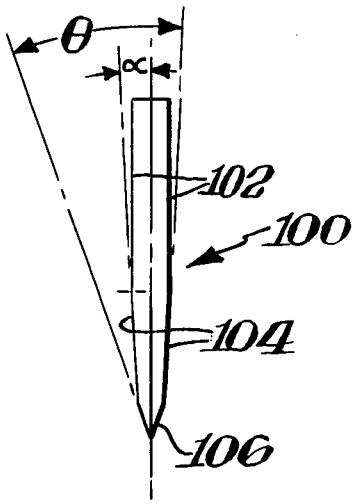
FIG. 11 is an enlarged cross-section in elevation of a typical knife of the prior art.

The magnetic element 136, FIG. 10, is located on the support member 134 preferably at that point closest to the moving abrasive surface for a variety of reasons but importantly to guide and position a knife 100 relative to its lower bevel face 104, shown in FIG. 11, rather than the upper bevel face 102 of the knife. While a magnetic guide can take on many forms it is critical that the guide face as determined by the magnetic element itself or by its immediate rigid physical surround establish a rigid guide plane to support the face of the knife. The guide is then oriented so that this guide plane intersects the plane of the orbiting abrasive surface on a line that is parallel to the line contact of the knife cutting edge facet as it rests against the plane of the orbiting abrasive during sharpening while the face of the knife rests on the guide plane.

Motion of the orbiting abrasive material 132, FIG. 10, generates forces on the knife cutting edge facet 106 that tend naturally to stabilize the knife's lower bevel face 104 against the magnet. Each cutting edge facet 106 is formed by the orbiting abrasive at a precise angle $\theta$ relative to the opposite lower bevel face 104. The planes of the cutting edge facets 106 converge to form the knife edge. Angle $\alpha$ is that angle formed by each lower bevel face 104 relative to the center line of the knife as shown in both FIGS. 10 and 11. Attempts to form the edge facets while positioning knives that have both an upper and lower bevel face such as 102 and 104 in FIG. 11 so that upper bevel face 102 is held against the magnetic holder led to greater instability, less precise control of sharpening angle, and hence less precision of the edge. For this reason, it is desirable to locate magnetic element 136 in the holder at a point where it will be adjacent exclusively or predominantly to the lower bevel face 104 of the knife.

Use of a magnetic material or magnet in contact with the knife serves another very important function in attracting the sharpening debris away from the abrasive surface and predominantly onto the knife. Ideally the magnetic field gradient is concentrated along the line of contact between the knife cutting edge facet and the abrasive elements so that the ferromagnetic sharpening debris is inductively magnetized at one polarity and attracted promptly toward the second magnetic polarity established on the knife face some distance from the line of contact with the abrasive surface. In this manner most of the debris is attracted to the face of the knife and never has opportunity to attach to the abrasive surface. With the relatively low velocity of the orbiting abrasive elements as described here the centrifugal forces on the sharpening debris are sufficiently low that they will not "throw" the particles away from this magnetic capturing effect. The ability of the magnetic field to remove and capture the particles prevents serious loading of the abrasive surface with the sharpening debris—a common and serious problem with prior art sharpeners. It was found that the magnetic field needed to be effective in stabilizing the knife and removing debris must provide a force holding the knife face to the magnetic means of around 4 ounces but preferably larger and on the order of 1–2 pounds for conventional household knives.

Advantages of the Invention

By using a very uniform repetitive orbital motion of the abrasive elements, in accordance with this invention that provides uniform omnidirectional abrasive action, several major advantages are realized over earlier knife sharpening methods. First sizeable burrs such as created along the knife edge by both the common motor-driven rotary sharpeners and the ubiquitous manual methods are virtually eliminated by this new method and means. The precisely repetitive cyclic orbital motion of an appropriate amplitude effectively removes burrs as they are being formed because the abrading action is uniform and omnidirectional. By employing the orbitally driven surface with an orbit circumference or path of about one inch or less such burrs never become large and are constantly removed while still small and mechanically weak. Use of a larger orbit circumference has a tendency to generate a larger and stronger burr that is not as readily removed by transverse abrasive action and to leave an edge with increased serration. A larger orbit also will lead to greater instability of the sharpening apparatus unless the mass or speed of the orbiting structure is reduced or the apparatus is bolted or otherwise secured to the counter or table.

Figure 14:
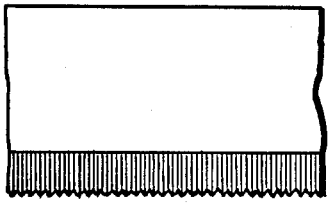
FIG. 14 is a schematic of a typical commercial knife face and cutting edge facet sharpened by prior art methods, shown enlarged 10×.

The unique orbital motion of this invention generates a knife edge that is virtually free of the type of teeth or serrations shown in FIG. 14 commonly observed in most commercial knives. Instead, the edge resulting from this invention contains fewer irregularities and the resulting knife will predominantly sever material cleanly as contrast to a significant tearing action. Edge qualities essentially equivalent to those common to scalpels and razors can be realized with this type of orbital motion.

Figure 15:
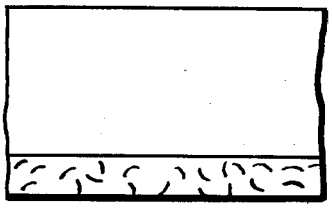
FIG. 15 is a schematic of a knife cutting edge facet sharpened in accordance with this invention, shown enlarged 10×.

By using an orbital motion based on a small precisely repetitive orbital path and a limited orbital velocity of the abrasive particles, and by elimination of major motions of the abrasive in a direction perpendicular to its principal orbital plane it is possible to create cutting edge facets on steel knives that can be brought to a "mirror" finish essentially free of imperfections under 50× microscopes as represented in FIG. 15. A "mirror" finish of this sort can be obtained readily with "grits" smaller than several microns, as viewed in specularly reflected light. Design elements that assist in attaining the required level of mechanical perfection include the use of gear pulleys with flexible segmented timing belts and a single or multiple three-point bearing support system described here.

Highly important to realizing this overall perfection is the use of a precise knife guide preferably of magnetic type that controls and maintains with high precision control of the angle of the face of the knife with respect to the plane of the abrasive in each stage; and by applying a concentrated magnetic field at that point where the cutting edge facet is being abraded it is uniquely possible to remove the predominant portion of the sharpening debris from the abrasive surface before it creates damage to the knife edge and before it reduces abrading efficiency by metal loading of that surface. The predominance of debris is instead collected on the face of the knife where it is readily removed. Edge imperfections of less than 0.0001 inch are attainable even with abrasive of about 600 grit that is about 1/1000 inch abrasive particle size. Finer grits will give a finer polish to the cutting edge facet and leave fewer edge imperfections. Knives of appropriate steel, total edge angle, and thickness sharpened in this manner even with a total edge angle of 45° can be used for shaving like conventional razors that normally have a smaller total edge angle.

In the sharpeners 20 and 110 illustrated in FIGS. 4 through 9, provision is included to interchange the abrasive surfaces as a means of either using a different abrasive or replacing worn surfaces. This means must be such as to ensure that each abrasive surface can be repositioned so that its plane is parallel to within 0.1 degree or so of the plane of the orbiting motion. Otherwise, the knife edge will encounter significant vibration during the sharpening process due to lateral motion of the abrasive surface. Such lateral motion can reduce significantly the quality of the edge being formed.

Figure 19:
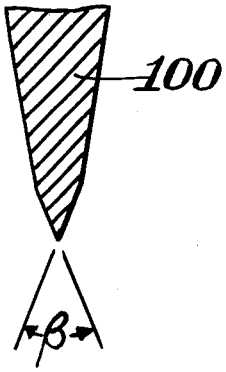
FIG. 19 is a cross sectional view of a typical knife.

The knife guides of this invention can be interchanged readily to permit the user to select the sharpening angle for the knife that is most appropriate for the intended knife usage. Depending on their intended use or purpose, knives are manufactured with the two cutting edge facets that form the cutting edge at a specific total included edge angle $\beta$ relative to each other, as shown in FIG. 19, that varies according to use and type. For example, many razor blades, scalpels, wood carving knives, and pocket knives and the like commonly are manufactured with a total edge angle as determined by the two facets, of 30 degrees or less. A large number of household knives including utility knives, general-purpose knives, and fillet knives have a total edge angle in the range 30–45 degrees. Knives for heavier duty are made with still larger angles and some chopping and steak knives are made with total included angles on the order of 60°, 90°, or larger. Scissors are edged about 70° to the mating faces.

To sharpen a knife where through usage the edge has become extremely dull, chipped, or irregular, on where one wishes to reduce the edge angle significantly, it is necessary to remove a substantial quantity of metal from the cutting edge facet before beginning the final facet abrading or polishing step. To provide for these possibilities, sharpeners according to this invention can be designed to accommodate a multiplicity of abrasive surfaces of varied abrasive and metal removal characteristics. It is possible to provide for use of coarse abrasives such as, for example, surfaces coated with larger diamond grit that because of its hardness can remove substantial quantities of metal rapidly. Following use of such coarse abrasives, successively finer abrasive surfaces or grits can be employed until an edge of appropriate sharpness is obtained. The limit in sharpness when using the teachings of this invention is determined largely by the grain structure and physical properties of the metal used in the knife blade.

In the apparatus and method described here, the size of the orbit must be sufficiently large and the rotational speed must be sufficiently large that, in combination, the circumferential velocity v of the abrasive particles is great enough to ensure sharpening in a reasonable length of time. Nevertheless, the circumferential velocity however attained must not be so large as to create excessive heating and localized detempering which will weaken or damage the knife edge. As the knife edge becomes thinner and finer it is progressively easier to overheat and remove the temper of the steel. The desirability of limiting the size of orbital path was discussed earlier. Because of those opposing factors and others to be described, there is an operating zone of circumferential velocity that optimizes the sharpening process, creates a superior edge, and virtually eliminates the possibility of taking the temper out of the knife edge.

The circumferential velocity of abrasive particles in orbit according to this invention has a simple relationship to the average orbital diameter and the orbit cycles per unit time, as follows:

$$v = \pi\, d \times RPM$$

Where v is circumferential velocity of the abrading particle, $\pi$ is approximately 3.1416, d is diameter of the orbiting motion, and RPM is the number of orbit cycles per minute.

The energy that each abrasive particle imparts to the knife cutting edge facet being sharpened and hence the sharpening rate is related to the particle circumferential velocity. Hence the energy and sharpening rate is related to the RPM. One wants to operate at the highest practical RPM, but the practical possibility of overheating the knife edge ultimately establishes a practical upper particle velocity of around 800 feet per minute. In addition, as a practical consideration, when the speed increases unwanted vibrations and instabilities may occur as a result of centrifugal force in an apparatus that is unclamped to the bench. Centrifugal forces and related effects can cause the apparatus to vibrate or even to "walk" off the supporting bench or table if that force is too large. This force can be minimized by reducing the orbital speed (RPM), by reducing the weight of the abrasive material, its support and base plate, or by reducing the size of the orbit. It can also be reduced or compensated for by introducing a mechanical means that provides an equal and opposing dynamic centrifugal force. Means for such counterbalance is known to those experienced in these arts and is not a part of this invention. With a sharpener with a total weight of around 5 pounds, the need for counterbalancing can be avoided if the weight of the total orbiting components incorporating the abrasive surfaces is held below a critical value defined by the following relationship; weight in ounces is less than $$\frac{3 \times 10^6}{d \times (RPM)^2}$$

where d is average diameter of the orbit in inches and RPM is the number of orbits per minute. Of course, clamping the sharpening apparatus to a heavy or massive base, incorporating added weights, counterbalancing or increasing the size of the base also will eliminate or reduce the tendency of the apparatus to "walk." However, these requirements or additions decrease the effectiveness and usefulness of a sharpener and otherwise encumber the sharpening device.

One typical operating condition for this type sharpener is an orbital cycle time equivalent to 1500 RPM (about 1/25 second per orbit) with an orbital circumference, or path, of about 0.3 inch which creates an orbital circumferential velocity of around 40 feet per minute. The weight of the orbiting abrasive member and its orbiting support structure was about 7 ounces. An orbiting path as large as 1 inch can be employed without need for bolting down the sharpener assuming a lower rotational speed or an orbiting structure of much lower weight according to the above relationship. By decreasing the weight of the orbiting components by increasing the total weight of the sharpener, by clamping the sharpener to a supporting structure, or by making other changes, the orbital circumferential velocity of the abrasive elements can be increased but it should not exceed about 800 feet per minute for reasons cited.

Quality of the finished knife edge was found to depend critically on the stability of the orbital plane of the moving abrasive member. In order to produce knife edges with imperfections no greater than 1/10,000 inch it is important that the magnitude of repetitive vibrations of the abrasive member in the transverse direction that is perpendicular to the orbiting plane of the abrasive, be held to less than ±5/1000 inch. The apparatus of this invention accomplishes this by the aforementioned drive system, the three point support bearing system to establish the plane of the orbiting base plate, and by close attention to construction details to insure that the principal plane of the mounted abrasive surface is parallel to the plane of the orbiting base plate driven by the eccentric cranks.

Details of Knife Guide Designs

It is important to provide a knife guide that ensures precisely reproducible positioning of the knife cutting edge facet during sharpening. Knife guide assemblies such as 122 in FIGS. 7, 8, 9 and 10, can be constructed in any of a variety of configurations. The described guide assembly 122 functioned well with an orbiting abrasive as taught in this disclosure, it represents a significant advance over guides described by others, and it is a superior guide for other abrasive motions including abrasive wheels, discs, or abrasives moving with a rectilinear motion. The open construction of magnetic guides as described here positioned contiguous to the abrasive surface with their absence of metal clip holders or enclosed structures to guide or hold the knife uniquely allow total accessibility of the knife to the abrading surface, from the tip of the knife to its handle.

Figure 12:
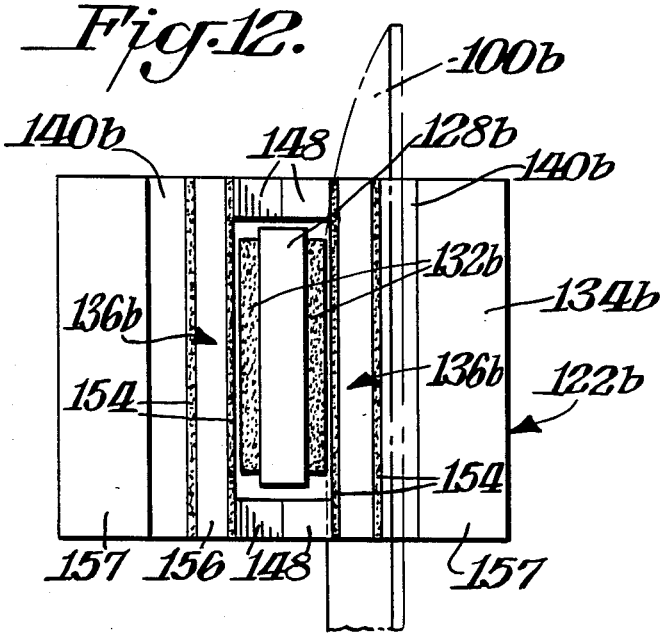
FIG. 12 is a top plan view of a knife guide employing magnetic means constructed in accordance with an embodiment of this invention.
Figure 13:
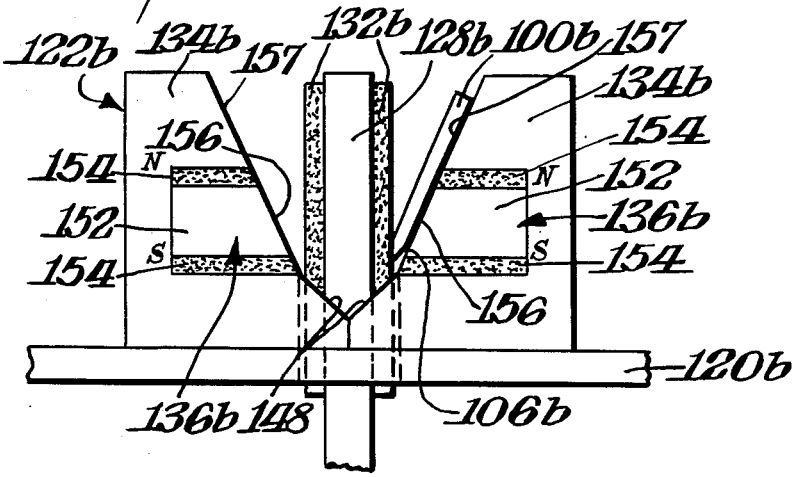
FIG. 13 is an elevation view of the knife guide of FIG. 12 employing magnetic means constructed in accordance with an embodiment of this invention.

Details of a knife guide constructed in accordance with this invention are illustrated in FIGS. 12 and 13. This guide incorporates a plastic support member **134*b* and incorporates a magnetic element 136*b* of preferred construction that attracts knife 100*b* with a force of more than 4 ounces in a manner similar to the embodiment of FIG. 10. This magnetic element 136*b* consists of upper and lower ferromagnetic plates 154 made for example of iron or steel that are on each side of polarized magnetic material 152. Any of the common metallic, or plastic embedded oxide magnetic materials can be used for the magnetic material 152 including Plastalloy 1A sold by the Electrodyne Company. The edges of metal plates 154, opposite abrasive material 132*b*, normally coplanar with the face of magnetic material 152 establish the magnetic guide face 156 as a first plane to guide the face of the knife and establish the sharpening angle $\theta$ relative to the abrasive surface. The magnetic guide means may include as part of the means a plastic film or paint on its guide face to reduce the opportunity to scratch the face of the knife 100*b* as it is moved across this face. The ferromagnetic material may alternatively be recessed one thousandth inch or so below the face of the magnetic material, enough to insure it will not scratch the face of the knife. The upper extension 157 of the guide face can be coplanar with the plane of the magnetic guide face 156 or it can be at a greater angle relative to the abrasive surface 132*b*, but it should not be at a lesser angle relative to the abrasive surface than the magnetic guide face 156 that establishes precisely the angle of the face of the knife with the abrasive surface 132*b* when the knife is in the normal sharpening position. The face of lower guide extension 148 establishes a second plane that can be coplanar with the magnetic guide face 156 or preferably at an angle of at least 5–30 degrees greater to the vertical so as to influence the position of the knife 100*b* and the knife edge if the user inadvertently inclines the knife 100*b* in the guide. If the user were to incline the knife cutting edge to the horizontal sufficiently, the heel of the cutting edge facet 100*b* would slide down the magnetic guide face 156 and onto the plane of the lower guide extension 148, that extends downward on each side of the abrasive surface. With the knife so inclined its edge will pivot angularly about a point on the face of the lower guide extension 148 and move the cutting edge angularly and vertically away from the slot, between the moving abrasive element 132*b* and the guide assembly 122*b*, and away from the edge of the orbiting abrasive 132*b*. By this means the opportunity for damage to the knife edge by the orbiting abrasive or its supporting upper arm 128*b* is reduced and there is less opportunity for vibration or instability of the knife in the guide. In normal operation, the knife 100*b* is held in a horizontal position as in FIGS. 12 and 13 as it is pulled through the guide by the user and neither the face of the knife or its cutting edge facets would contact the second plane formed by the lower guide extension 148**. This type of knife guide has proven precise and reproducible for a wide range of knives including those with two bevel faces and those with hollow ground lower bevel faces.

With a magnetic element **136*b* as shown in FIGS. 12 and 13 with the magnetic field oriented so that one magnetic pole is adjacent to upper metal plate 154 and the other magnetic pole is adjacent to lower metal plate 154, the plates separated by about one-quarter inch, it was found that the knife 100*b* tends to be positioned automatically to a natural position by the magnetic field effects in the direction of the abrasive plate 132*b* so that its cutting edge rests just beyond the lower ferromagnetic metal plate. This positioning effect is optimized if the magnetic guide face is covered by a low friction paint or film. The knife's vertical cutting edge facet 106*b* is pulled down the magnetic guide face 156 and against the abrasive surface 132*b* by these natural magnetic field effects on the knife 100*b*. The actual abrading force created as a result of this pulling effect of the magnetic field on the knife with such a structure can be controlled by selection of the physical spacing between the abrasive surface and the lower metal plate 154 and to some degree it is affected by the geometry of the knife. The pulling effect can if desired be large enough to support the knife when resting in the guide without human assistance. With a closer spacing the abrading force is greater. With the knife in its natural position as established by the magnet, if the spacing is increased sufficiently the vertical cutting edge facet 106*b*, will not touch the abrasive surface unless the user applies some pressure on the knife to move it further down the guide face until it touches the abrasive surface. I have discovered that because of these effects this particular magnetic guide arrangement can serve to simultaneously position the knife, minimize any vibration of knife due to abrading forces control the sharpening angle $\theta$—the angle of the blade face as related to the plane of the abrasive surface, remove sharpening debris from the abrading surface, and provide a simple means to insure a steady level of force of the knife cutting edge facet against the abrasive surface and hence insure a uniform omnidirectional abrading rate. The intersection of the first plane established by the magnetic guide face and the second plane established by the lower guide extension 148 should be on a line just below and parallel to the position of the heel of the lower cutting edge facet 106*b* when the vertical cutting edge facet 106*b* is in physical planar contact with the orbiting abrasive surface and the knife's cutting edge is horizontal within this type holder. If the intersection were at a higher position one would lose control of the sharpening angle $\theta$. Hence the lower guide extension 148** is not intended to be a guide for the knife when the knife is in the normal sharpening position.

If the guide is constructed so that it has an otherwise unobstructed gap, t, between the guide and orbiting abrasive surface, as shown in FIG. 10, there is reasonable possibility that a knife can be forced into that gap space damaging the knife or jamming the orbiting abrasive surface. It was found desirable where such gaps, t, exist to utilize a stop for the knife which can take many forms and in a preferred embodiment is located exterior but adjacent to the gap and sharpening zone.

Figure 16:
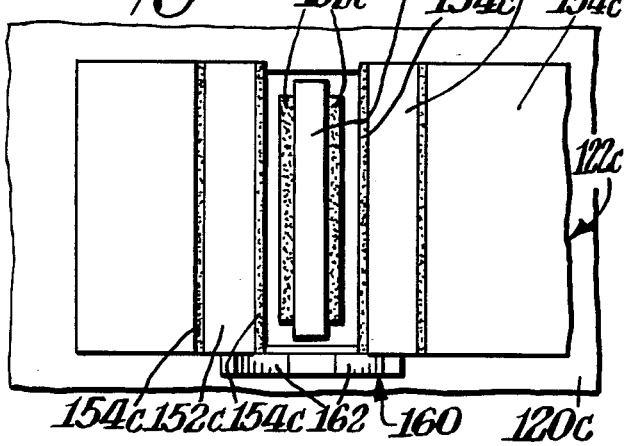
FIG. 16 is a plan view of a knife guide employing a knife stop located exterior to the sharpening zone constructed according to another embodiment of this invention.
Figure 17:
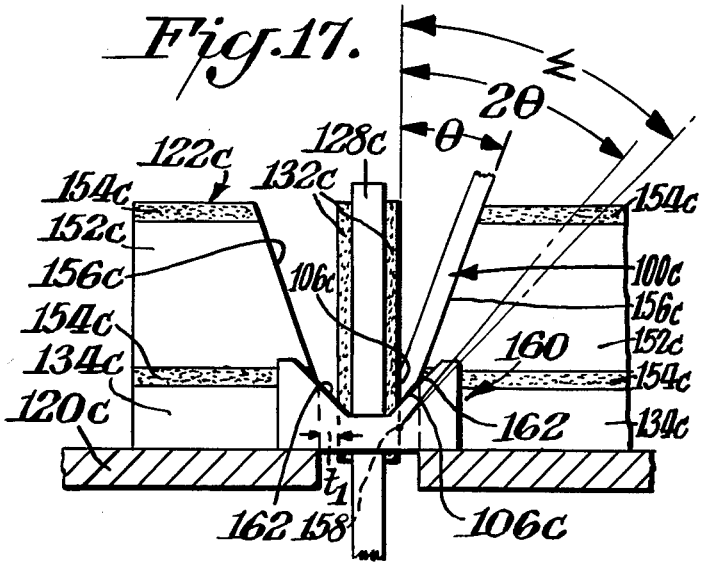
FIG. 17 is an elevation view of the knife guide of FIG. 16 employing a knife stop located exterior to the sharpening zone according to another embodiment of this invention.

A knife guide **122*c* incorporating a stop is shown in FIG. 16 and FIG. 17. This embodiment of the invention employs a magnetic material 152*c* in arrangement similar to FIGS. 12 and 13 where its magnetic north and south poles are capped with ferromagnetic plates 154*c* made of steel or iron. The edges of metal plates 154*c* opposite abrasive material 132*c*, coplanar with the face of magnetic material 152*c* establish the plane of the guide face 156c to guide the face of the knife and establish the sharpening angle $\theta$ relative to the abrasive surface. A stop 160 positioned in a plane nominally perpendicular to the abrasive surface as shown fastened to guide support plates 120c by an adhesive or screws (not shown) exterior to but adjacent to the sharpening gap, preferably with sloping faces 162 sloping down toward the abrasive surface serves a variety of functions. First it acts as a guide for the edge of knife 100c to seat it firmly against abrasive material 132c, and it serves to wipe sharpening debris from the edge or cutting edge facet. The stop 160 is usually located such that the stopping action on the knife edge occurs at a point vertically in FIG. 17 near or just above that point 158 where the plane of the sloping guide face 156 intersects the principal plane of the orbiting abrasive material 132c. The stopping action thus occurs essentially at the point where some part of the cutting edge facet would be located during the normal sharpening action. The cutting edge itself commonly is located at a point which is slightly above the intersection of the plane of the guide face 156c with the principal plane of the abrasive surface. The stop 160 may be of a suitable plastic, but its sloping faces 162 may be a hard or abrasive material such as titania or alumina adhered thereto by a suitable adhesive that serves simultaneously to guide the knife edge and to abrade, remove, or reorient any burr on the knife edge as it is passed over the guide, and to sharpen further the knife edge. The entire stop 160** can be made of the abrasive material if more convenient for constructional reasons.

Selection of an appropriate angle $\Sigma$ FIG. 17 for the edge of sloping face 162 of the stop 160 relative to the principal plane of the abrasive surface depends on the intended use of that stop. The angle is chosen with regard to the total angle $\beta$, FIG. 19, being created on the knife blade. If for example the total blade angle is to be 40° and one wishes to use the edge of stop's sloping face 162 not only as a knife guide but either to provide a sharpening action or to remove, or reorient burrs or debris on the knife edge or knife edge facet 106, FIG. 11, it is desirable that the edge of sloping face 162 rub against the tip of the cutting edge facet 106, FIG. 11. To accomplish that, the angle $\Sigma$ would be selected to be equal to or slightly greater than $\beta$, say 40°–45° in this example. The angle $\Sigma$ should not in any case be so much greater than $\beta$ that the force created on the knife edge as the knife is moved across sloping face 162 will be damaged. Alternatively if the primary use of the stop 160 would be to guide the knife 100c against the abrasive, the angle $\Sigma$ might be less than $\beta$ so that that portion of the knife where edge facet 106, FIG. 11, and lower bevel face 104 intersect, rather than the side of the cutting edge, would tend to rub on the edge of sloping face 162 of stop 160.

It is significant to note that angle $\beta$ is slightly different from twice the angle $\theta$ (i.e. $2\theta$) shown in FIGS. 10, 11 and 17 whenever the knife blade has two bevel faces 102 and 104, as in FIG. 11, at an angle to each other. Angle $\beta$ is less than $2\theta$ by an amount equal to $2\alpha$ where $\alpha$ as shown in FIGS. 10 and 11 is often found to be in the range of 2–3 degrees, but can be larger or smaller.

With the sloping face 162 of stop 160 set at an angle slightly greater than $\beta$, it is uniquely possible to reorient any burr or debris that might be on the knife cutting edge in a direction away from the sloping face 162 and toward the abrading surface. If such burr reorientation precedes contact of the knife cutting edge facet with the abrasive, the remaining burr or debris can be cleanly and readily removed, creating a knife edge exceptionally free of such burrs and debris.

When used only as guide for the cutting edge, the stops sloping face 162 can be made of a hardened, nonabrasive material such as martensitic steel or glass to avoid any significant abrasive action. When it is desirable to obtain a mild sharpening action on the knife edge as it is moved over the guide stops sloping face 162, that face would preferably be made of a hard, fine grit abrasive material such as fine titania, harder than the knife. Excessive abrasive action is to be avoided at the final stage in order not to damage the excellent knife edges generated by the orbiting abrasive elements. For this reason a very mild abrasive material such as titania is preferred generally over more severe abrasive surfaces. Generally the quality of edges produced by the orbiting motion is so high that subsequent abrasive action against the fine edge is likely to be counterproductive.

The optimum vertical position for the knife edge or knife cutting edge facet 106 to contact the sloping face 162 of stop 160, FIGS. 16 and 17, depends upon the shape and dimensions of knife 100 being sharpened, the width of gap, t, between the abrasive material 132c and the guide base material 134c and the sharpening angle $\theta$ as shown in FIG. 17. Relative to the principal plane of the abrasive material 132c and the plane of guide face 156c the stopping point on sloping face 162 should be close to the intersection point 158 between these planes or preferably slightly higher as illustrated in FIG. 17 by an amount related to the thickness of the knife to be sharpened. Generally some portion of one cutting edge facet 106c of knife 100c or the side of the knife edge will rest on the stop's sloping face 162 when the opposite edge facet 106c is in intimate line contact with the plane of the abrasive surface 132c and the appropriate bevel face of knife 100c is in intimate contact with the angle-controlling plane of the guide face 156c of knife guide 122c. To accommodate a wide variety of household knives stop 160 should be located so that when some point along the cutting edge facet 106c contacts the sloping face 162, the cutting edge itself is in its normal sharpening position on the order of 1/32 to 1/16 inch above intersection point 158. With use of such a stop and a gap, t, on the order of 1/16 inch the guide will accommodate a reasonable range of knives without jamming. The stop's sloping face 162 located vertically as described above, can be positioned as shown in FIG. 16 immediately adjacent to, that is along side of the abrasive surface 132c —removed just sufficiently so that neither abrasive material 132c or support arm 128c will contact the stop 160. It is also possible to use a microstop located within the gap, t, either with or without the external stop described.

When the stops sloping face 162 slopes downward toward the abrasive material 132c as in FIG. 17, it can serve a variety of functions which include guiding the knife 100c so that its cutting edge facet 106c is steadied against abrasive material 132c at the appropriate position and reducing the opportunity for the knife 100c to slip into the gap t. It can serve also to remove or reorient any burr or sharpening debris in a direction toward the abrasive surface so that if the knife edge or edge facet 106c is passed over and in contact with the guide sloping face 162 immediately prior to its contact with abrasive material 132c, that debris or burr is readily removed by the abrasive action, leaving edge facets 106c essentially free of such attachments. Such stops are useful not only for orbiting abrasive surfaces but for others such as abrasive disks and abrasives moved rectilinearly for example.

With the magnetic means of FIGS. 12 and 13 or 16 and 17, the magnetic materials 152 and 152*c* may be permanent two pole magnets with their north poles, for example, in the upper position in contact with the upper ferromagnetic metal plate 154 and their south magnetic poles in contact with the lower ferromagnetic metal plate 154. The magnetic means may include a surface coating or a film adhered thereto to reduce friction, to protect the face of the knife from possible scratching as it is moved across the guide plane established by this means and to facilitate optimum positioning of the knife by the magnetic field. During sharpening the face of the knife is in intimate physical contact with this means and the lower magnetic pole of this means is situated adjacent to the cutting edge facets of the knife. The one cutting edge facet is in contact with the abrasive surface thereby conducting the magnetic pole to the surface of the abrasive at the point where the sharpening debris is being generated by the sharpening process. Because the face of the knife is in such intimate physical contact with the magnetic guide means and the magnetic poles are in effect both parallel to and in contact with the face of the knife, both magnetic poles are transferred nominally to the face of the knife at those points of closest physical contact to the magnetic pole positions. Sharpening debris is inductively magnetized by the first magnetic pole concentrated in the vicinity of the cutting edge facets and immediately attracted to one of the magnetic poles lying within the face of the knife. The predominent fraction of the sharpening debris is attracted by this mechanism to the face of the knife where it can be readily removed by a wiping action either as the knife is withdrawn from the sharpening zone or subsequent to sharpening. These magnetic effects together with the scrubbing action of the knife against the moving abrasive surface removes most of the sharpening debris so that it does not either ball up and interfere with the regularity of the abrasive surface or fall into and ultimately jam or damage the mechanical parts and drive system. Some stray particles of debris may, and depending on the geometry of the magnets, have enough velocity to escape the magnetic field at the knife edge and be attracted to the magnet structure itself. Debris that collects on prior art abrasive surfaces moved either manually or by a mechanical means tends to ball-up, interfere with the sharpening action and create nicks in the knife edge. Where two magnetic holders are used in juxtaposition as shown in FIGS. 16 and 17, it is preferable that their magnetic fields be oriented similarly for example with both north magnetic poles in the up position so as to maximize the attraction of debris during sharpening to the knife 100*c*. When the knife is removed the strong magnetic field immediately adjacent to the active portion of the abrasive surface continues to "scrub" the abrasive surface to clear it of remaining sharpening debris.

Figure 18:
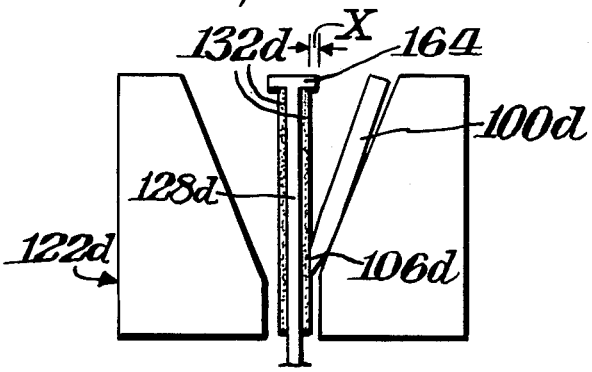
FIG. 18 is an elevation view of a knife guide and abrasive support member with protruding protective structure in accordance with still another embodiment of this invention.
Figure 20:
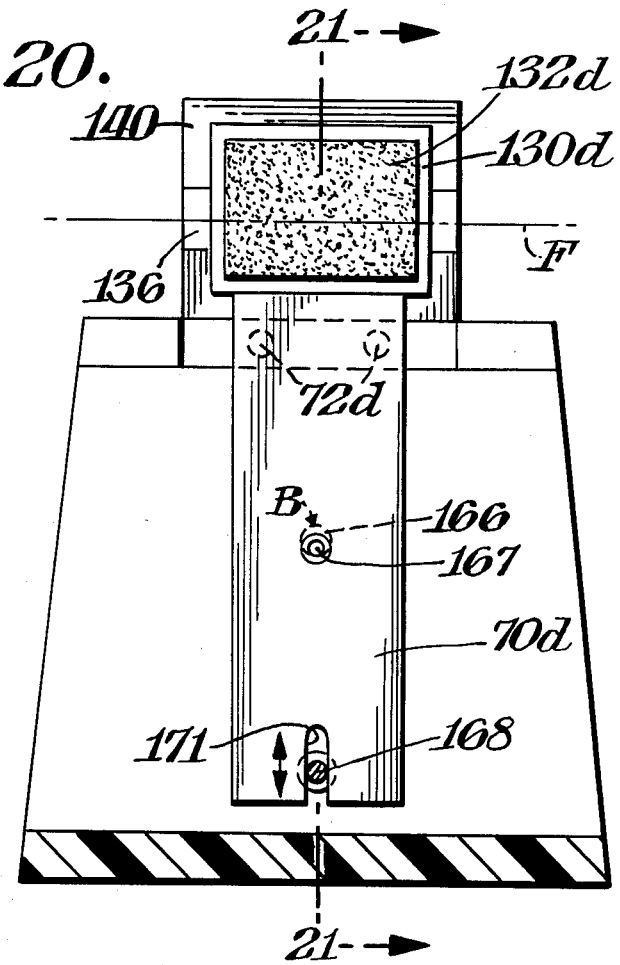
Figure 21:
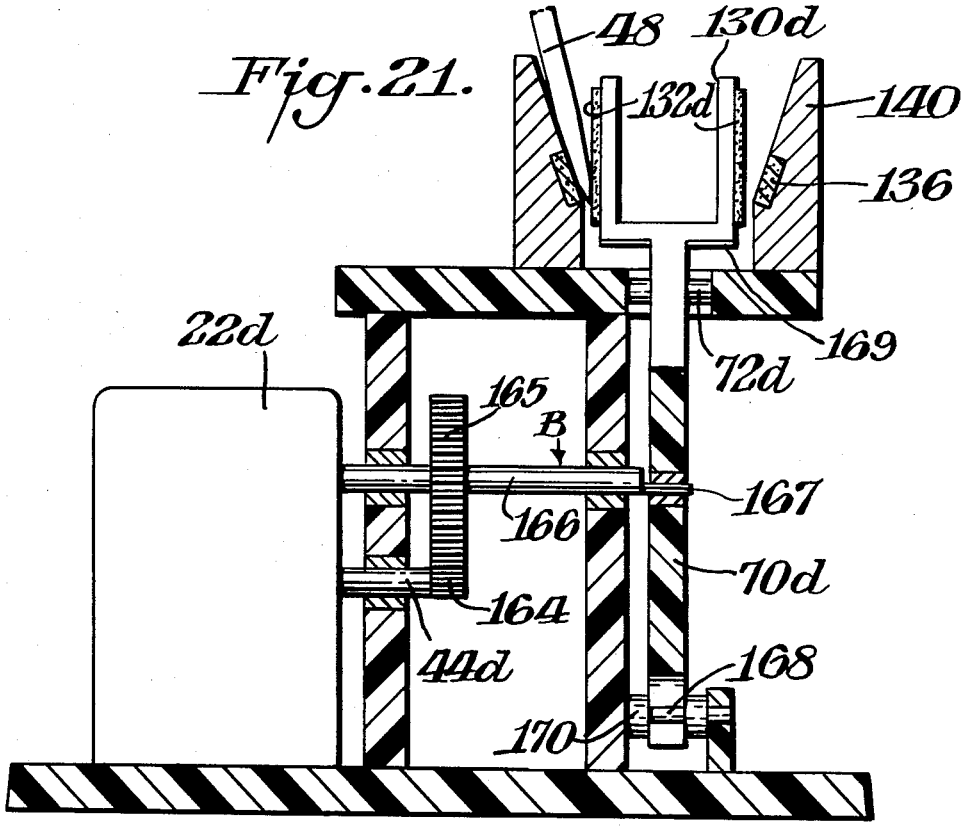

FIG. 18 shows a further improvement in the orbiting support structure of FIGS. 7, 8 and 9 to reduce the opportunity for the upper surface of the knife blade to accidentally contact the abrasive surface element. In FIG. 18 the knife 100*d* is supported by a knife guide assembly 122*d* where the knife cutting edge facet 106*d* rests on the orbiting abrasive material 132*d*. A protective extension 164 of the upper portion of yoke's upper arm 128*d* protrudes slightly beyond the plane of the abrasive material surface 132*d* by a distance X in the direction of the guide. With a plate of orbiting abrasive material on the order of ½ inch high, a distance X on the order of 1/64 to 1/32 inch is usually sufficient to provide this protection. However, the geometry and optimum dimensions depend on the height of the abrasive plate, knife width, and on the sharpening angle of the knife guide relative to the orbiting abrasive plate. An excessive extension of the protective extension 164 of the upper arm 128*d* will interfere with the ability to insert wide knives into the space between the protective extension 164 and the knife guide assembly 122*d*. Preferably the protective extension 164 of the upper arm 128*d* should be made of a suitable plastic or other material that will not scratch or abrade the surface of knife 100*d* upon contact. This type extension could be used with abrasive surfaces moving with different motions such as reciprocating or oscillating rectilinear motions vertical or horizontal by way of example.

The invention may be embodied in other specific forms without departing from the spirit or essential characteristics thereof. The present embodiments described here are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A knife sharpening apparatus for sharpening a knife having a face terminating at a cutting edge facet comprising an abrasive surface, drive means operatively connected to said abrasive surface for imparting a motion to said abrasive surface, magnetic knife guide means having a magnetic guide surface in a plane disposed at a predetermined angle to and intersects said abrasive surface to form a line of intersection therewith, said magnetic knife guide surface having two opposite polarity magnetic poles comprising a north pole and a south pole, oriented such that each pole lies along a line which is substantially parallel to said line of intersection one of said north and said south poles being disposed along a portion of said magnetic guide surface which is remote from said abrasive surface and the other of said north and said south poles being disposed along a portion of said magnetic guide surface which is contiguous to said abrasive surface to create a magnetic field at said abrasive surface, said magnetic field being of a strength to provide a thrust to move the cutting edge facet into contact with said abrasive surface and a force to hold the cutting edge facet in contact with said abrasive surface while said abrasive surface is in motion.

2. Apparatus according to claim 1 wherein said pole disposed contiguous to said abrasive surface is spaced from said abrasive surface by a distance on the order of 1/16 inch of less without any intervening structure between said magnetic means and said abrasive surface.

3. Apparatus according to claim 1 wherein said abrasive surface is planar.

4. Apparatus according to claim 1 wherein said abrasive surface is planar to define a principal plane, said abrasive surface having a peripheral edge, stop means located in a plane intersecting said principal plane, and said stop means being located outwardly beyond said peripheral edge of said abrasive surface.

5. Apparatus according to claim 1 wherein said magnetic means further comprises means for removing metallic sharpening debris away from said abrasive surface.

6. Apparatus according to claim 1 wherein said magnetic means has a greater width than the width of said abrasive surface, and said magnetic means spans said abrasive surface.

7. Apparatus according to claim 1 wherein said abrasive surface includes as abrasive elements a plurality of diamond grit.

8. Apparatus according to claim 1 wherein said abrasive surface includes a plurality of abrasive elements, and said drive means orbitally drives said abrasive surface with said abrasive elements moving along paths of about equal length.

9. Apparatus according to claim 8 wherein said drive means produces an orbital path no greater than one inch and imparts a velocity of no greater than 800 feet per minute to said abrasive elements.

10. Apparatus according to claim 9 wherein said abrasive surface is disposed on a sharpening member, said drive means including support means having at least three points of contact with said sharpening member and confining the motion of said abrasive elements to less than ±0.005 inch in a direction perpendicular to said abrasive surface, and restraining means including spring means holding said orbiting assembly in intimate sliding contact with said support points.

11. Apparatus according to claim 9 wherein said drive means includes a pair of synchronous eccentric drive cranks, a planar orbiting assembly including a drive plate engaged by said cranks, said sharpening member being mounted on said assembly, and said assembly having sets of at least three support point contacts contacting each side of said drive plate with each set of support point contacts being in a plane parallel to said abrasive surface.

12. Apparatus according to claim 4 wherein said stop means has a sloping edge at an angle with respect to said principal plane, said sloping edge angle being plus or minus 20 percent of twice said predetermined angle.

13. Apparatus according to claim 1 wherein a protective overlay is disposed on said knife guide means along said magnetic guide surface to minimize any scratching of the face of the knife.

14. Apparatus according to claim 13 wherein said magnetic means includes ferromagnetic material which is recessed below said guide surface.

15. Apparatus according to claim 1 wherein said magnetic poles are spaced about one-fourth inch apart from each other.

16. Apparatus according to claim 1 wherein said magnetic field establishes a holding force of at least four ounces.

17. Apparatus according to claim 1 wherein a non-abrasive member is secured to said abrasive surface, said non-abrasive member extending in a direction perpendicular to said abrasive surface in the direction of said guide surface a distance of about 1/16 inch to thereby protect the lower face of the knife from inadvertent contact with said abrasive surface.

* * * * *